US006192636B1

(12) United States Patent
Hayashi et al.

(10) Patent No.: US 6,192,636 B1
(45) **Date of Patent: *Feb. 27, 2001**

(54) METHOD OF FORMING A BASE STRUCTURE ASSEMBLY USED IN A WOODEN AXIAL STRUCTURE IN WOODED ARCHITECTURAL CONSTRUCTION AND JOINT PARTS THEREOF

(75) Inventors: Yuuichirou Hayashi, Sakata; Keiji Satou, Amarume-machi; Noboru Naitou, Sakata, all of (JP)

(73) Assignee: Hayashi Kensetsu Kougyou Co., Ltd., Sakata (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/595,506

(22) PCT Filed: Sep. 10, 1993

(86) PCT No.: PCT/JP93/01300

§ 371 Date: Dec. 30, 1994

§ 102(e) Date: Dec. 30, 1994

(87) PCT Pub. No.: WO94/06971

PCT Pub. Date: Mar. 31, 1994

Related U.S. Application Data

(63) Continuation of application No. 08/240,662, filed on Dec. 30, 1994, now abandoned.

(30) Foreign Application Priority Data

Sep. 18, 1992 (JP) ..... 4-275032

(51) Int. Cl.[7] ..... E02D 27/02

(52) U.S. Cl. ..... 52/126.7; 52/293.3; 52/299; 52/745.15

(58) Field of Search ..... 52/299, 293.1, 52/292, 263, 741.15, 169.9, 126.6, 126.7, 293.3

(56) References Cited

U.S. PATENT DOCUMENTS

| | | | | |
|---|---|---|---|---|
| 8,860 | * | 4/1852 | Williams | 52/292 |
| 2,078,969 | * | 5/1937 | Patterson | 52/293.3 |
| 2,194,279 | * | 3/1940 | Goldborough | 52/292 |
| 2,359,304 | * | 10/1944 | Davison | 52/299 |
| 2,943,716 | * | 7/1960 | Babcock | 52/653.1 |
| 3,562,978 | * | 2/1971 | Ali-Oglu | 52/263 |
| 4,015,375 | * | 4/1977 | Lindsay | 52/292 X |
| 4,275,538 | * | 6/1981 | Bounds | 52/299 |
| 4,328,651 | * | 5/1982 | Gutierrez | 52/293.1 |
| 4,565,044 | * | 1/1986 | Takahara | 52/293.1 |
| 4,584,801 | * | 4/1986 | Weinberger | 52/299 |
| 5,103,613 | * | 4/1992 | Kinoshita | 52/292 |
| 5,295,754 | * | 3/1994 | Kato | 403/174 |

FOREIGN PATENT DOCUMENTS

| | | | | |
|---|---|---|---|---|
| 2260666 | * | 9/1975 | (FR) | 52/299 |

* cited by examiner

*Primary Examiner*—Michael Safavi
(74) *Attorney, Agent, or Firm*—Armstrong, Westerman, Hattori, McLeland & Naughton

(57) ABSTRACT

A method of forming a base structure assembly used in a wooden axial structure in wooden architectural construction includes the steps of forming a basic foundation, positioning a joint part having a supporting leg serving as an anchor bolt, fixing a each end of prepared base members, one after another, to base member joint portions which face each other, adjusting a level thereof, completing a base construction or a floor structure, and forming a basic concrete structure between the base foundation and the lower part of the base. Joint parts conducting the method includes pillar leg joint portions which is provided at the top end of a bar member wherein a pillar legs are inserted into, base member joint portions provided around said top end of said bar, a supporting leg provided at the lower part of said bar, and a level adjusting mechanism incorporated in the proper place of the bar.

3 Claims, 4 Drawing Sheets

METHOD OF FORMING A BASE STRUCTURE ASSEMBLY USED IN A WOODEN AXIAL STRUCTURE IN WOODED ARCHITECTURAL CONSTRUCTION AND JOINT PARTS THEREOF

This application is a continuation of application Ser. No. 08/240,662 filed Dec. 30, 1994, now abandoned.

TECHNICAL FIELD

This invention relates to a method of forming a base structure assembly used in a wooden axial structure in wooden architectural construction, which is a traditional Japanese architectural style structure, and joint parts thereof. More particularly, this invention relates to a method of forming a joint structure for three construction parts; namely, a base foundation, a base, and pillar leg parts, along with pillar leg joint parts used thereof. This invention abandoned the traditional way of such a construction, and made it possible to take totally different steps in constructing wooden assembly around the base area by developing new parts. This invention aims to improve the efficiency in construction, to standardize construction parts, and to make construction more accurate and stronger. Eventually, this invention can realize an economical way of constructing wooden architecture.

BACKGROUND ART

Japanese traditional wooden axial structures are highly praised in the world due to their perfect joint formations. Only skilled carpenters, who can perform highly skilled techniques in processing depth of cut, can complete the assembly. The number of such skilled carpenters is, however, decreasing year after year. As younger generation lose interest in the traditional architectural field, it is difficult to train young workers to learn the skills. Besides, the carpenters who have been playing an important role in building wooden houses are getting older.

Due to the above-mentioned circumstance, so-called "two by four method" or various kinds of prefabrication methods have become more popular because they do not require carpenters with special skills or techniques. On the other hand, some people are not satisfied with prefabricated houses; and the demand for the traditional Japanese wooden architecture remains high, especially after Japan has accomplished economic development which made it possible for people to seek relaxation. Consequently, the construction industry has to respond to such a demand, but the industry is confronted with a difficult situation to meet such a demand.

Under such circumstances, the applicant of this invention realized a wooden axial structure which does not need the traditional joint work to make a joint structure on top of a pillar and can be constructed as a simple factory production as disclosed in Japanese Laid Open Patent Publication Nos. HEI4-153446 and HEI4-169641. This invention not only resolves the problem resulting from the lack of skilled carpenters, but also provides an improvement over any other known methods in resolving such problems as the limit of construction mode, guarantee of supply in time, rising cost, more space needed in a vertical direction of pillar head joint structure, the gap of the top edge in each crossing transverse and so on.

This invention is based on a series of technical ideas deeply related to inventor's own construction style. Specifically, This invention relates to a new method of forming unique structures around the base area and the pillar leg joint parts (hereafter, a pillar leg means the leg part of a wooden pillar assembled on the first floor) to accomplish such a method.

The followings are the detailed description of the construction.

DISCLOSURE OF INVENTION

As shown in the embodiment in the attached drawings, the method of forming a base structure assembly used in a wooden axial structure in wooden architectural construction is basically composed of the following constructions.

A method of forming a base structure assembly used in a wooden axial structure in wooden architectural construction of the present invention includes the steps of forming a basic foundation by at least cutting, spreading stones or sands and placing concrete according to a basic construction drawing; positioning joint parts having a pillar leg joint portion, base member joint portions and a supporting leg serving as an anchor bolt on the base foundation at a position where a wooden pillar is positioned; fixing each end of base members, one after another, to said base member joint portions which face each other according to the first floor construction drawing, adjusting a level thereof, and completing a base construction or a floor structure; and forming a basic concrete structure between the base foundation and a lower part of said base wherein said level has already been adjusted.

Base foundation is formed by enforcing the ground by driving in piles according to the basic construction drawings; spreading sands or stones on the piled ground after cutting and battering are done; making the surface smooth; and thereafter placing concrete on the surface. This base foundation supports the basic structures chosen according to the architecture built on top of it; e.g. the base, the independent base, the raft foundation, and so on.

Therefore, this basic foundation is not limited to the combination of stones or sands, and the concrete placed thereon, as long as sufficient durability to support the basic structure is guaranteed.

On the roughly even surface (i.e. not a standard surface like a finished one), the exact places to put wooden pillars for construction are marked according to the first floor drawings. Then joint parts are positioned on these marks. When the joint parts are not formed as an independent form, the joint parts should be connected to one end of the base member (as described later) or supported by other appropriate parts before the joints parts are positioned on all the exact positions to place wooden pillars for construction according to the first floor construction drawings.

Aside from the case in which the connection to the base member joint is processed one after another at the same time, both ends of the base member, which is already processed in accordance to the first floor drawings, are usually connected to a position between each base member joint portion constructed on top of the pillar leg joint portions which have already been processed and positioned in the appropriate positions. A base construction, according to the first floor construction drawing, or a floor construction combined with a flint member or a sleeper is thus completed. The base at this stage should look like it is detached from the basic foundation, and should be adjusted so as to be exactly even.

The above-described procedures are not limited to what has been described above. As long as the structure where the base is evenly detached from the basic foundation is completed, any procedure should suffice.

As for the joint parts, as long as the joint parts can sustain the strength and length to keep the base from the foundation at a certain height and can function as an anchor bolt after they are buried in the concrete basic foundation, there is no restriction in their material and structure. Therefore, any structure of a steel bar and a steel tube or a shaped steel formed in a bar style can be chosen and used provided that the structure has a pillar leg joint portion and base member joint portions on the top structure thereof; and provided that on the bottom structure thereof, it has a supporting part which can easily locate the mark described above. In short, it is sufficient that a structure is provided which can make the base independent, adjust the height, and avoid movement after the location thereof has been arranged.

Also, a structure of pillar leg joint portions and base member joint portions can be constructed with metal or rectangular lumber if the structure can roughly form a joint structure. This structure arrangement depends upon the situation with the wooden pillars (as described later), the pillar leg of the base, and the joint parts formed on both ends of the base.

Wooden pillar in this invention means a construction pillar (e.g., Japanese cypress, cedar or hemlock lumber either 105 mm or 121 mm square) which is positioned on the first floor. The lumber should be processed in a factory to have pillar leg structure which can be connected to the joint parts of the pillar leg joint portions (e.g., a pivot, mortise, bolt hole placed horizontally, cutting, added special parts or the like) are formed singly or in combination.

The base has the same size as that of the above-described wooden pillar. Both ends have the structural arrangement which can be connected to the joint structure of the base member joint portions. Pivots, mortis, bolt holes placed horizontally or vertically, cutting, added special parts or the like are processed singly or in combination in a factory.

The base has the axial structure with main and sub bases with construction space in between, and is shown later in embodiment according to a series of the inventor's technical idea. The joint structure of the main base should be formed in a body with a short rectangular lumber of the same size attached to it with glue or screw bolts. The joint structure formed on both ends of the sub base, which is placed to keep a certain working distance on top of the main base, should be formed so as to have the joint structure with both a cutting and vertical bolt hole.

After the base construction or the floor construction, according to the first floor drawing, has been exactly formed on the concrete foundation with the support of pillar leg joint portions, basic construction parts are then formed according to the standard process applied to the architecture. For example, if it is a concrete one, concrete is piled into proper frames so that base, independent base, or raft foundation base can be constructed. If it is a partially or totally prefabricated one, frames are omitted, and after the preparation for parts arrangement such as water strings is done, prefabricated basic construction parts are connected one after another.

When the concrete base structure is piled at a working site, concrete piles are laid horizontally using the pillar leg joint portions, which fit in the frame. When the base structure with prefabricated parts is assembled at a working site, already arranged pillar leg joint portions are placed to fit the joints of each prefabricated parts; then, each pile jotting out of adjacent prefabricated parts are connected directly or indirectly through the medium of pillar leg joint portions. After the connection, concrete is piled and pillar leg joint portions are buried in the concrete. Consequently, the joint parts can function so as to maintain the even level at a certain height, and can also function as anchor bolts to make the base united with the foundation.

BEST MODE FOR CARRYING OUT THE INVENTION 1

For a better understanding of this invention, the preferred embodiment of the joint structures and each of the joint parts for the embodiment, shown in the attached drawing, are described as follows.

Figure 1:
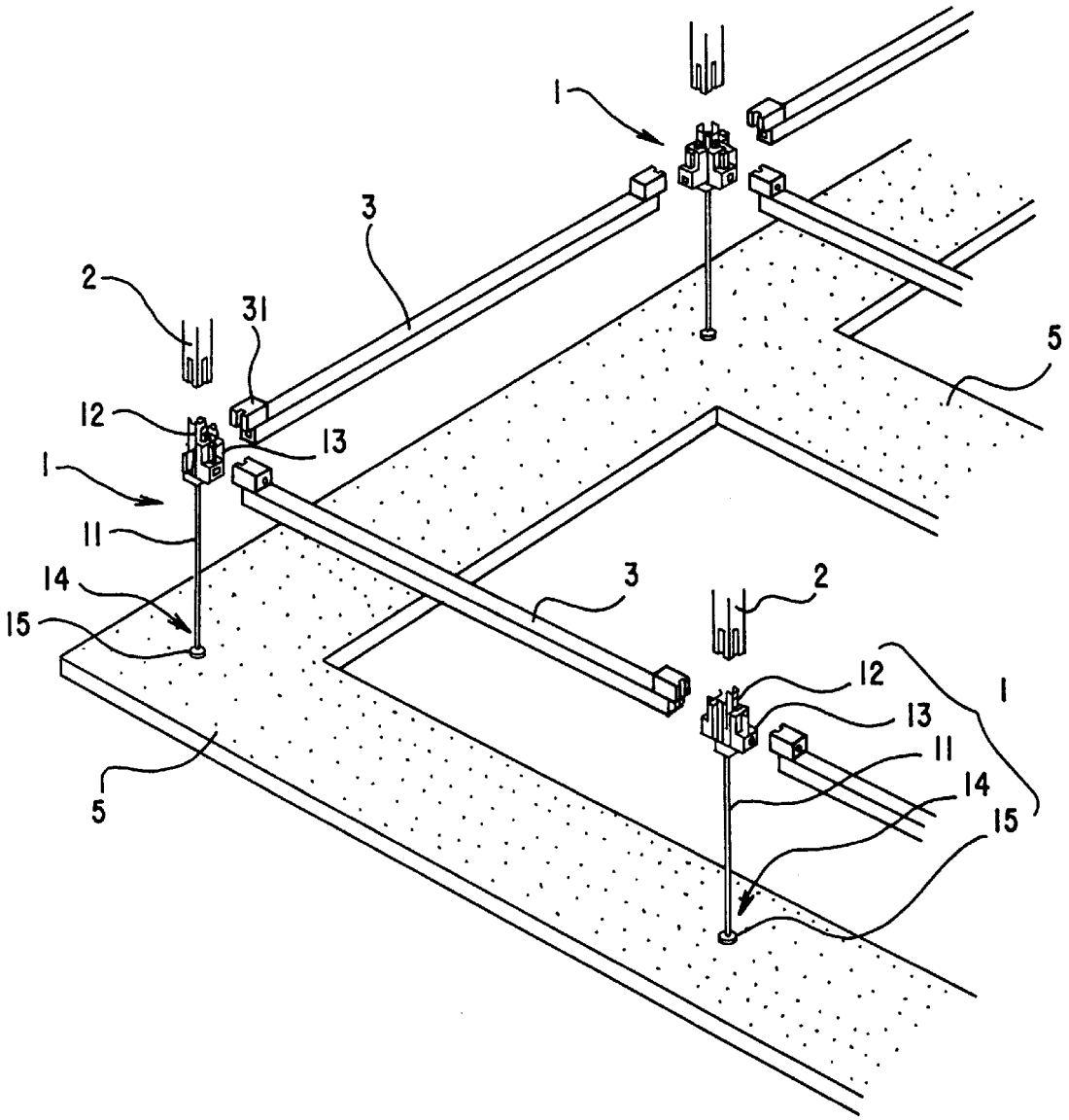
FIG. 1 shows an embodiment to represent this invention.
Figure 2:
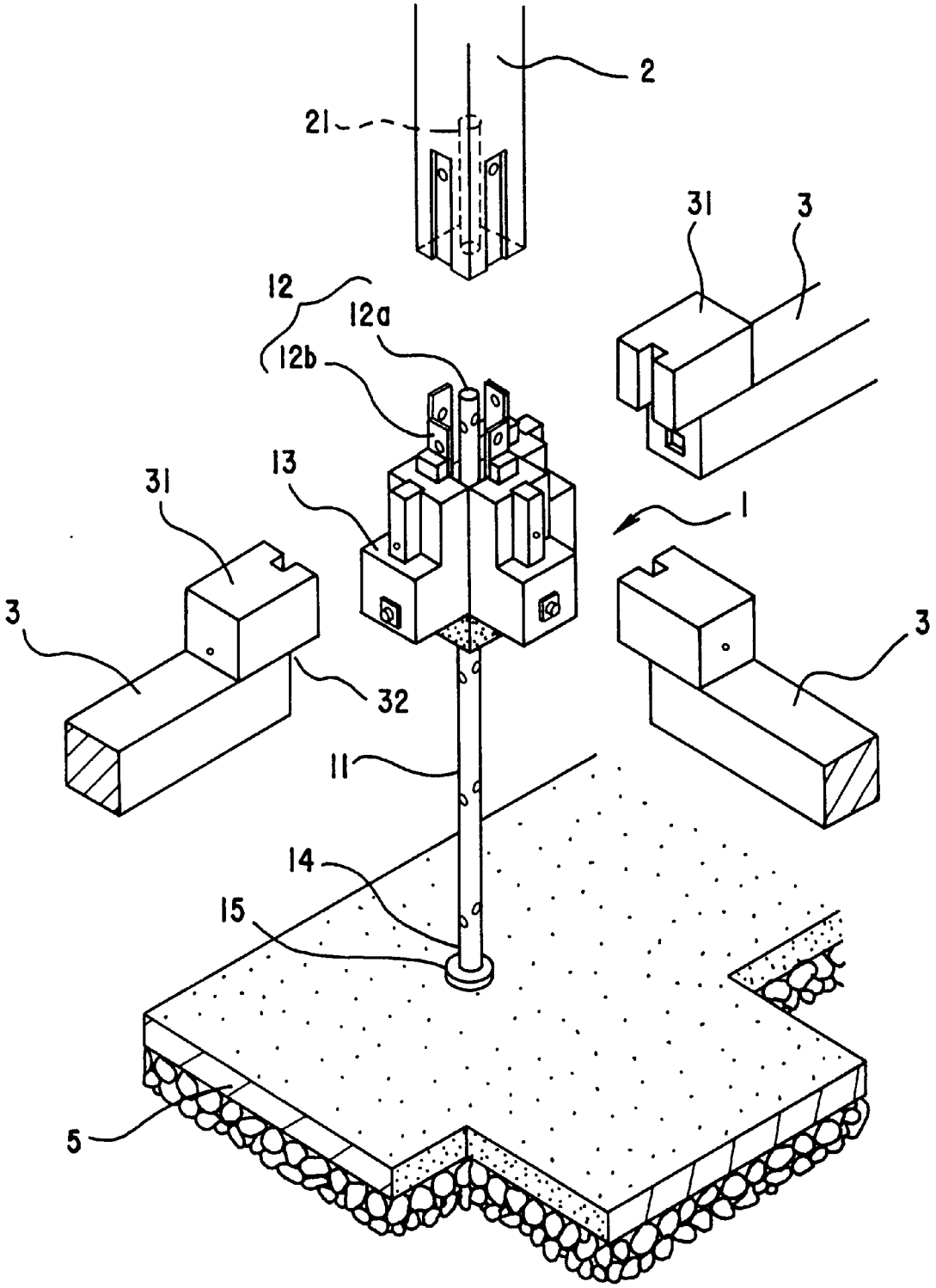
FIG. 2 is a partially enlarged view of FIG. 1.
Figure 3:
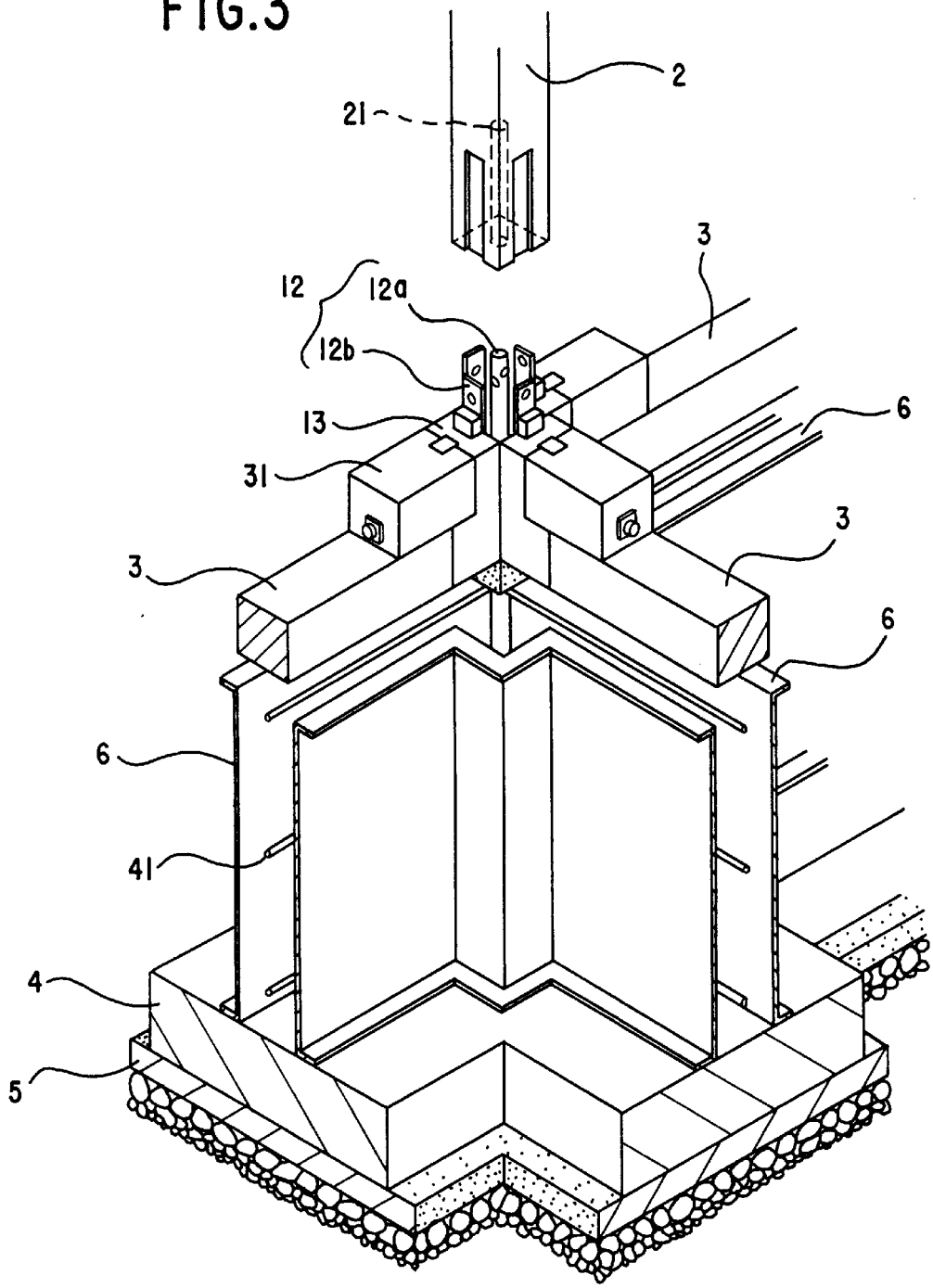
FIG. 3 is a partially perspective view showing the manner in which the base foundation is formed.
Figure 4:
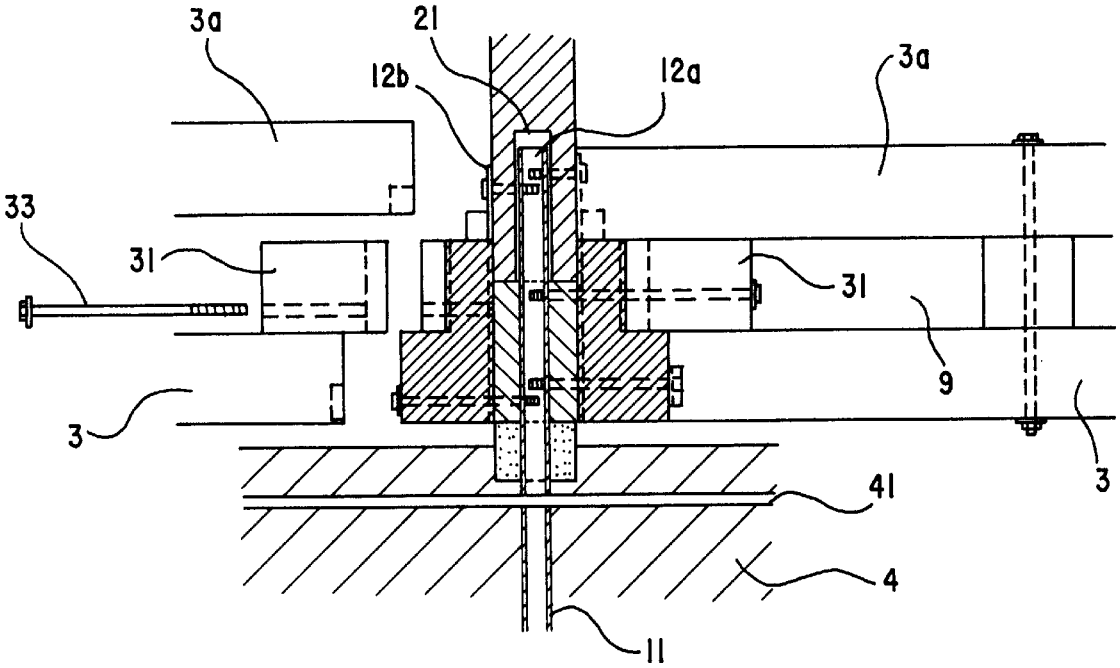
FIG. 4 is a partially exploded enlarged sectional view showing joint parts around the base area.

FIG. 1 is a partially exploded perspective view showing the method of this invention; FIG. 2 is an enlarged exploded perspective view; FIG. 3 is an enlarged perspective view showing the state just before piling of concrete into the frames; and FIG. 4 is a partially exploded vertical sectional view showing the connection structure of a pillar leg joint portion.

In this embodiment, joint parts 1 can not independently function. That is, on the top of the joint parts 1, a pillar leg joint portion 12 and base member joint portions 13 are provided. These parts are formed in accordance with each connecting direction to a wooden pillar 2 and a base 3. A supporting leg 14 of the joint parts 1, 1 . . . is positioned at the exact position on the basic foundation 5; namely, where the center of a wooden pillar for construction is placed in accordance to the first floor construction drawing (a place marked beforehand, which is hidden under supporting leg 14 in FIG. 1).

Both ends of each base 3 are connected to respective joint parts 13, 13 . . . of the adjacent joint parts 1, 1 . . . In this manner, the joint parts 1, 1 . . . become established on top of the basic foundation. Consequently, the base construction is formed at a certain height over a concrete foundation 5. The joint parts formed on both ends of base 3, apparent from FIG. 2, are processed at a factory to be symmetrical so that each one can be connected to either base member joint portion 3 of the joint parts 1.

In this embodiment, in order to realize joggling joint between the joint parts 1 and the base member joint portion 13, a wooden member 31, which is roughly the same scale as the base member 3, is overlaid on the base member 3 with its end protruding and connected thereto (by glue, and a nut and bolt, not shown). A recessed portion 32 are placed on the seat port of the base member joint portion 13, and a wooden member 31 and a base member joint portion 13 are tightly connected with a bolt 33, as shown in the enlarged vertical cross sectional view of FIG. 4.

While the bolt 33 is screwed to steel pipe bar member 11, the main part of the joint member 11, when two base member joint portions which are arranged symmetrically are connected, one bolt penetrate through wooden members 13, 13 and the base joint holding the wooden member 13, 13 can be used to connect them with a nut.

In this manner, the base member 3, 3, . . . is connected and incorporated to the joint parts 1, 1 . . . which is positioned at the exact position where the center of a wooden pillar for construction is placed according to the first floor construction drawing in order to complete the base construction. At this stage, if there are any positioning errors of the joint parts, the position thereof are correctly adjusted. Subsequently, level adjusting of the base member 3, 3 . . . is conducted. Therefore, the adjustment of the base member 3, 3 . . . is not conducted by guiding the top end of the foundation structure, which is different from the prior art.

The process of forming a foundation, not shown in the drawings, includes the arranging of a flint member or a sleeper. Also, by enforcing the joint parts or by providing support members to the base foundation 5, the process of constructing above a second floor can be included.

After the setting of the base foundation, as shown in the enlarged perspective view of FIG. 3, iron reinforcing rods 41, 41 are fixed to the pipe bar member 11 in order to form a base foundation 4. Thereafter, frames 6, 6 . . . are fixed on the base foundation 5: and raw concrete is placed into the frames. After a certain period of time, the frames 6, 6 are removed; and the outer surface of the base foundation is mortared if necessary.

In this embodiment, in order to make the placing of the concrete easier, a deformation port which functions as a concrete inlet is provided . However, when a large aperture is formed between the top of the base foundation 4 and the bottom of base member 3, the frame having such a deformation port is not necessary. The frames 6, 6 . . . themselves are formed as an outer surface of base foundation, and the mortar treatment is omitted. As described above, as the top of the base foundation does not relate to the leveling of the base, the top of the base foundation is roughly adjusted.

Finally, a wooden pillar 2 for the first floor is engaged with the pillar leg joint portions, and rectangular metals 12*b*, 12*b* . . . and connecting portion 12*a* of the iron pipe bar member 11 are connected with nuts and bolts in order to conduct a construction of the first floor.

In this embodiment, in consideration of the wooden axial structure that the applicant of this invention has already realized, a supplemental base member 3*a* is provided over the base member 3 at a predetermined distance in order to make a gap portion operating space 9 and supplemental base 3*a* is shown in FIG. 4. However, the technical idea of this invention is not limited to this embodiment.

Although the fixing means of the supplemental base member 3*a* is not shown in the drawings, the base member 3 which is connected to the base member joint portion 13 of the joint parts 1 and wooden member 31 are incorporated by a bolt (not shown) penetrating therethrough and protruding to the operating space 9 and tightened with a nut.

BEST MODE FOR CARRYING OUT THE INVENTION 2

Joint parts 1 are essential to the method of forming a base structure assembly used in a wooden axial structure in wooden architectural construction described above.

Figure 5:
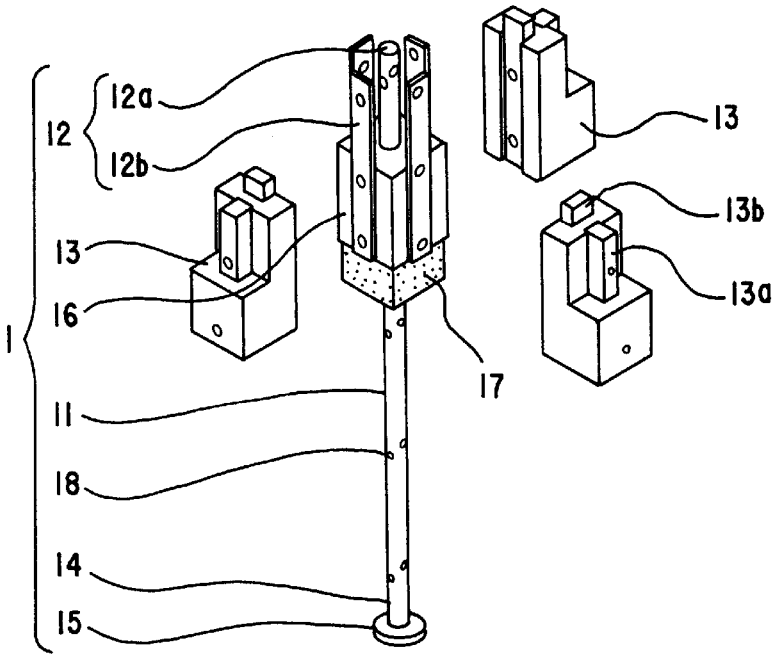
FIG. 5 is a partially exploded perspective view showing a middle leg joint structure.

FIG. 5 is an exploded view of the joint parts 1.

The present invention is joint part comprising a bar member; pillar leg joint portions which is provided at a top end of the bar member 11 wherein pillar legs are inserted thereinto; base member joint portions 13, 13 . . . provided around the top end of the bar member 11, the base member joint portions 13 being formed in a connecting direction of the base member 3; a supporting leg provided at a lower part of the said bar member 11; and a level adjusting mechanism incorporated in said bar member 11, wherein the level adjusting mechanism avoids to interfere with the functions of the pillar leg joint portion and the base member joint portions 13.

In this embodiment, for the bar member 11, an iron pipe is used. At the top end of the bar member 11 is a portion 12*a* which is inserted into a insertion hole 21 provided in the wooden pillar. A short pillar 2 having the same size as the wooden pillar is connected to the wooden pillar at the bottom. Around the short pillar 12, rectangular metals 12*b*, 12*b*. . . are provided facing the insertion portion 12*a*. These portions 12*a* and rectangular metals 12*b* form the pillar leg joint portion 12.

On the other hand, on the short pillar member holding the rectangular metals, joggled wooden members, which is longer than the short pillar member 16 and shorter than rectangular metals 12*b*, is provided for covering the rectangular metals 12*b*. The short pillar members 16 and rectangular metals 12*a* are incorporated into the bar member 11 with bolts constituting the base member joint portion 13. Reference numeral 17 in the drawings shows the bolt used herein.

The figure of the base member joint portion 13 is dependent on one of the edges of the base member 3. In this embodiment, joggled wooden member is used to realize a joggling joint. The base member joint portion 13 may be provided only on the surface of the short pillar member 16 where the base is connected. Therefore, the incorporated joint part 1 is preferably prepared in the factory in advance in five different types which correspond to the connection pattern of the base members 3.

A supporting leg 14 is provided at the bottom of the bar member 11. The supporting leg 14, at least when the base is connected, must be strong enough to withstand the weight and length thereof, and must be longer than the height of the constructed base foundation.

At a position of the supporting leg which does not interfere with the functions of the pillar leg joint portion and the base member joint portions (i.e., the lower end of the bar member or within a proximity thereof), the level adjusting mechanism 15 is incorporated. With the operation of the level adjusting mechanism, the length of the joint parts can be adjusted. In this embodiment, the level adjusting mechanism 15 is realized by a wide-head bolt screwed to the lower end of the bar member.

In the drawings, reference numeral 7 shows a concrete packing material which prevents the lower surface of the short pillar member 16 and the base members 13 from touching the base foundation which is construct at a later time later and damaging the endurance thereof, while reference numeral 18 shows a portion for incorporating therein the iron reinforcing rod.

In the base member joint portion 13 of this embodiment, a dowel protrusion 13*a* and a projection 13*b* are provided in order to conduct automatically accurate positioning of the base member 3. It goes without saying that these means can be replaced by another means or omitted.

INDUSTRIAL APPLICABILITY

According to the method of forming said base structure assembly used in a wooden axial structure in wooden architectural construction and joint parts thereof, the base members 3, 3. . . are assembled in accordance with the first floor construction drawing and the levels thereof are adjusted before forming the basic construction 4. Therefore, the formation of the basic construction, especially the work for making its top surface even, no longer requires time and attention as it did before. The advantageous effects of retaining the even level of the base member 3, 3 . . . efficiently and accurately attained in this invention. Each crossing end of the wooden pillar 2, base 3, support base 3*a* of the axial assembly member enables the construction of a joint part without exposing their joint metals. Each axial assembly member 2, 3, 3*a* can be standardized. This standardization can also be done in order to standardize floor and wall panels, which should be assembled in these axial assembly members.

As this method allows the floor assembly to be exactly constructed according to the first floor drawing, this invention has the significant advantage of completely avoiding complicated work procedures of adjusting floor assembly construction at the building site. That is, there is no need to repeat the process to correct the level of the base members 3, 3 . . . as in conventional traditional methods. Prior to this invention, to achieve accurate floor assembly was difficult because to position the base member 3, 3 . . . was affected by the location of the anchor bolts on the basic construction.

Consequently, joint parts, which is the most important member of the wooden axial assembly and requires much time and attention, can be produced in a very simple machine process at a factory and do not need skilled carpenters like before. Moreover, at the working site, simplified construction can be guaranteed by just assembling standardized and simply made joint parts one after another. It is thus a significant benefit of this invention to the construction industry for coping with the lack of skilled carpenters.

Especially, as shown in the embodiment, the structure is easily ready-made, because all the joint parts 31, 31 . . . for the base member on the joint part 1 are designed to be exactly the same, and the structure of both ends of the base 3 is also designed to match joint parts 31 for base member. Eventually, the efficiency for the assembly can be remarkably improved.

Also, in order to adjust the level of the base member 3, an adjusting member can be used at the bottom of the pillar leg 14. However, the adjustment of the base member can be done more efficiently by the level adjustment mechanism 15, like a screw bolt, which is incorporated in the pillar leg 14 which serves as an anchor bolt in the joint part 1.

In order to conduct the method of forming a base structure assembly used in a wooden axial structure in wooden architectural construction, as shown in the embodiment of this invention, the joint parts having the base member joint portions 13, 13 formed on the upper end of the bar member like a steel pipe and the pillar leg which the level adjusting mechanism is incorporated on the lower end thereof can be employed. Since the joint parts can be easily standardized and are produced economically, the method of forming a base structure assembly used in a wooden axial structure in wooden architectural construction of this invention can be conducted economically.

As mentioned above, the method of forming a base structure assembly used in a wooden axial structure in wooden architectural construction and joint parts thereof can contribute to the standardization of the parts used in the wooden axial structures, which has been difficult in the traditional methods. Also, this invention can improve the efficiency of the construction work without affecting the traditional construction style. Furthermore, this invention can improve the strength of the construction. Therefore, this invention can resolve the problems due to the lack of skilled carpenters and can shorten the period of construction in the traditional construction industries. Also, this invention can provide people, who are not satisfied with the prefabricated houses and who demand for the traditional wooden houses, with a house at a price which is equivalent to the prefabricated houses at a price which is equivalent to the price of a prefabricated house.

What is claimed is:

1. A base structure assembly used in a wooden structure, said base structure assembly comprising:

a plurality of bar members;

a plurality of pillar leg joint parts, each of which is provided at a top end of each said plurality of bar members;

pillar legs inserted into said pillar leg joint parts;

a plurality of base member joint parts provided at said top end of each of said plurality of bar members;

a supporting leg provided at a lower end of each of said plurality of bar members; and a level adjusting mechanism incorporated in a lower end of each said plurality of bar members;

wherein said level adjusting mechanism avoids interference with the functions of said pillar leg joint parts and said base member joint parts, and wherein said level adjusting mechanism comprises a wide-head screwbolt.

2. A method of forming a base assembly for a wooden structure including a plurality of horizontally-arranged base members and a plurality of vertically-arranged pillars, comprising the steps of:

forming a base foundation on the ground;

forming a plurality of joint part assemblies each formed by connecting together a pillar leg joint part, a base member joint part and an upper end of a supporting leg, wherein said upper end of said supporting leg is secured to said base foundation in each said joint part assembly;

mounting one of said plurality of wooden pillars on each said joint part assembly;

fixing each end of said plurality of base members, one after another, to said base member joint part;

adjusting levels of said base member joint parts;

completing a floor structure; and forming a basic concrete structure between said base foundation and said plurality of base members, wherein said step of level adjusting includes the step of adjusting with a level adjusting mechanism incorporated in said lower end of said supporting leg, and wherein said level adjusting mechanism comprises a wide-head screwbolt.

3. A method of forming a base assembly according to claim 2, wherein both first and second ends of each of said plurality of base members, coupled between said base member joint parts, have the same configuration.

* * * * *